US011346223B2

(12) United States Patent
Navanteri

(10) Patent No.: US 11,346,223 B2
(45) Date of Patent: May 31, 2022

(54) DISC TURBINE WITH STATIC DISTRIBUTOR

(71) Applicant: ESQUARE LAB LTD, Gillingham (GB)

(72) Inventor: Vincenzo Navanteri, Spoltore (IT)

(73) Assignee: ESQUARE LAB LTD, Gillingham (GB)

( * ) Notice: Subject to any disclaimer, the term of this patent is extended or adjusted under 35 U.S.C. 154(b) by 240 days.

(21) Appl. No.: 16/631,261

(22) PCT Filed: Jul. 19, 2018

(86) PCT No.: PCT/EP2018/069596
§ 371 (c)(1),
(2) Date: Jan. 15, 2020

(87) PCT Pub. No.: WO2019/016302
PCT Pub. Date: Jan. 24, 2019

(65) Prior Publication Data

US 2020/0208524 A1 Jul. 2, 2020

(30) Foreign Application Priority Data

Jul. 19, 2017 (EP) ..... 17182152

(51) Int. Cl.
*F01D 1/36* (2006.01)
*F04D 17/16* (2006.01)
*F01D 1/26* (2006.01)

(52) U.S. Cl.
CPC ..... *F01D 1/36* (2013.01); *F04D 17/161* (2013.01); *F01D 1/26* (2013.01);
(Continued)

(58) Field of Classification Search
CPC ..... F01D 1/36; F04D 17/161
See application file for complete search history.

(56) References Cited

U.S. PATENT DOCUMENTS 1,061,206 A 5/1913 Nikola
2,640,678 A * 6/1953 Andresen ..... F03B 1/00 415/76

(Continued)

FOREIGN PATENT DOCUMENTS

WO WO90/15581 * 12/1990
WO 2012004127 A1 1/2012

OTHER PUBLICATIONS

International Search Report, dated Oct. 11, 2018, for corresponding PCT patent application No. PCT/EP2018/069596.

*Primary Examiner* — Eldon T Brockman
*Assistant Examiner* — Brian O Peters
(74) *Attorney, Agent, or Firm* — Abelman, Frayne & Schwab; Stefan Knirr

(57) ABSTRACT

The present invention relates to a disc turbine for converting the energy associated with a fluid into mechanical energy. The turbine (1) comprises a housing and a rotor (4) inside said housing (3) which can rotate with respect to it about a rotation axis (100). The rotor (4) comprises a plurality of disc elements (11A, 11B) coaxial with said axis. The turbine is characterized in that it comprises a distributor (5) with a distribution wall (5A) which at least partially surrounds the discs. Such a wall (5A) is arranged inside said housing (3) so as to define a diffusion chamber (7) with the housing itself, which chamber at least partially surrounds the distribution wall (5A). The latter comprises a plurality of nozzles (6A, 6B, 6C, 66A, 66B, 66C), each of which is provided with an inlet section (61) communicating with said chamber (7), an outlet section (62) adjacent to the discs (11A, 11B), and a converging portion (615) which accelerates said fluid towards said outlet section (62).

14 Claims, 7 Drawing Sheets

(52) U.S. Cl.
CPC .... *F05D 2240/128* (2013.01); *F05D 2250/25* (2013.01); *F05D 2260/85* (2013.01)

(56) References Cited

U.S. PATENT DOCUMENTS 4,201,512 A * 5/1980 Marynowski ..... F01D 1/36
415/66
6,726,442 B2 4/2004 Letourneau

* cited by examiner

DISC TURBINE WITH STATIC DISTRIBUTOR

CROSS REFERENCE TO RELATED APPLICATIONS

This application is a national phase of PCT application No. PCT/EP2018/069596, filed Jul. 19, 2018, which claims priority to EP patent application No. 17182152.3, filed Jul. 19, 2017, all of which are incorporated herein by reference thereto.

FIELD OF THE INVENTION

The present invention relates to the field of rotary machines for transforming the enthalpy associated with a flow of gas, vapor or other fluid into mechanical power which can be used for other purposes. In particular, the present invention relates to a disc turbine which uses the viscosity of an inlet fluid as a means for converting the energy associated with the fluid itself into mechanical power made available at the output.

BACKGROUND ART

Disc turbines are known in the field of operating machines used for converting the energy associated with a flow of gas, vapor or other fluid into mechanical power. Disc turbines typically comprise a rotor which supports the discs, between which a passage gap is defined and crossed by a fluid entering the turbine. The rotor may be connected, for example, to an electrical generator or, in all cases, to a shaft to which a load is connected. More precisely, the fluid crosses the passage gap defined between each pair of adjacent discs and due to its viscosity determines a force which makes the discs rotate about the rotation axis of the rotor, thus generating mechanical power available to a shaft associated with the rotor. Substantially, in disc machines, the variation of momentum between the fluid (at high speed) and the rotor (relatively slower than the fluid) occurs as a result of the adhesion of the fluid to the surface of the discs skimmed by the fluid instead of as a result of the aerodynamic lift effects achieved by the circulation about the wing profiles, as it occurs in turbo machines with wing profiles.

U.S. Pat. No. 1,061,206 describes a disc turbine comprising nozzle configured to accelerate the fluid and to orient the respective flow according to a direction tangential to the discs. Patent application WO 2012/004127 and FR 30238968 describe a solution which is conceptually similar to that described in U.S. Pat. No. 1,061,206. In particular, the disc rotor is inserted inside a cylindrical wall defining an opening at which a nozzle is arranged orientated to accelerate the fluid and to allow its introduction between the discs according to a tangential direction. After having crossed the space between the discs, the fluid is discharged at an axial cavity of configured by the discs themselves.

The technical solutions described and shown in the documents mentioned above have various drawbacks, the main of which is the limited efficiency by which the fluid is converted into mechanical energy. It has been seen that this aspect depends on the distribution system of the fluid between the rotor discs. In this regard, in the solutions described above, the fluid entering the turbine directly reaches the nozzles, whose outlet section has a height which corresponds to the total height of the disc group (considered according to a direction parallel to the direction of the rotation axis of the rotor). This conformation determines high loss of load at the outermost edge of the discs. Indeed, part of the fluid is not inserted directly between the discs but instead collides against the outermost edge of the discs themselves, thus generating a turbulence region. In addition to the load losses, this behavior of the fluid determines bending loads on the disc rotor. Such loads are not balanced and, in addition to decreasing the overall mechanical efficiency, negatively impact the reliability and the durability of the rotor.

Another drawback of the traditional solutions is found in the positioning systems of the nozzles about the discs associated with the rotor. The systems currently used are very complex and make the assembly of the turbine also particularly complex. This aspect strongly impacts also the manufacturing costs for obtaining the fluid passage sections, which are higher. Such sections must be normally made using automatic control milling machines in order to obtain passage sections, such machines must ensure accuracy and finishing of the machined surfaces at the same time.

On the basis of the considerations above, it is the primary task of the present invention to provide a disc turbine which allows to overcome the drawbacks mentioned above. Within this task, it is a first object of the present invention to provide a disc turbine which allows to increase the efficiency of the energy conversion of the fluid into the mechanical energy with respect to traditional solutions. It is another object of the present invention to provide a turbine which allows to distribute the fluid more uniformly at the rotor discs. It is another object of the present invention to provide a disc turbine provided with a distribution system capable of addressing the fluid so as to achieve a balanced thrust on the rotor, whereby avoiding, or in all cases reducing, flexural thrusts. It is a not last object of the present invention to provide a disc turbine which is reliable and easy to be manufactured at competitive costs.

SUMMARY

The present invention thus relates to a disc turbine for converting the energy associated with a fluid into mechanical energy. The turbine according to the invention comprises a feeding section and a discharge section, for letting fluid into and out from the turbine, respectively. The turbine further comprises a housing communicating with the inlet section and a rotor, inside said housing, which can rotate with respect to it about a rotation axis. Such a rotor comprises a plurality of disc elements coaxial to the rotation axis and spaced apart so that a passageway communicating with the outlet section is defined between each pair of adjacent elements.

The turbine according to the invention is characterized in that it comprises a distributor comprising at least one distribution wall which at least partially surrounds the discs of the rotor. Such a wall is inside the housing and arranged so as to define a diffusion chamber between the wall itself and the housing. Such a diffusion chamber at least partially surrounds the distribution wall. According to the invention, the distribution wall defines a plurality of nozzles, each of which comprises an inlet section communicating with the diffusion chamber and an outlet section adjacent to the rotor discs. Each nozzle further comprises at least one converging portion which accelerates the fluid towards the outlet section of the nozzle itself.

Unlike the traditional solutions, the presence of a distributor and of a diffusion chamber about it allows the fluid to reach all the nozzles substantially in the same thermodynamic conditions. The definition of the nozzles through a distribution wall which surrounds the discs represents another very advantageous aspect. Indeed, the nozzles allow a uniform distribution of the fluid about the discs. Concurrently, the assembly of the turbine appears much simpler and faster than the traditional solutions.

LIST OF DRAWINGS

Further features and advantages of the present invention will become more apparent from the following detailed description provided by way of non-limiting example and shown in the accompanying drawings, in which.

The same reference numbers and letters in the figures refer to the same elements or components.

DETAILED DESCRIPTION

Figure 1:
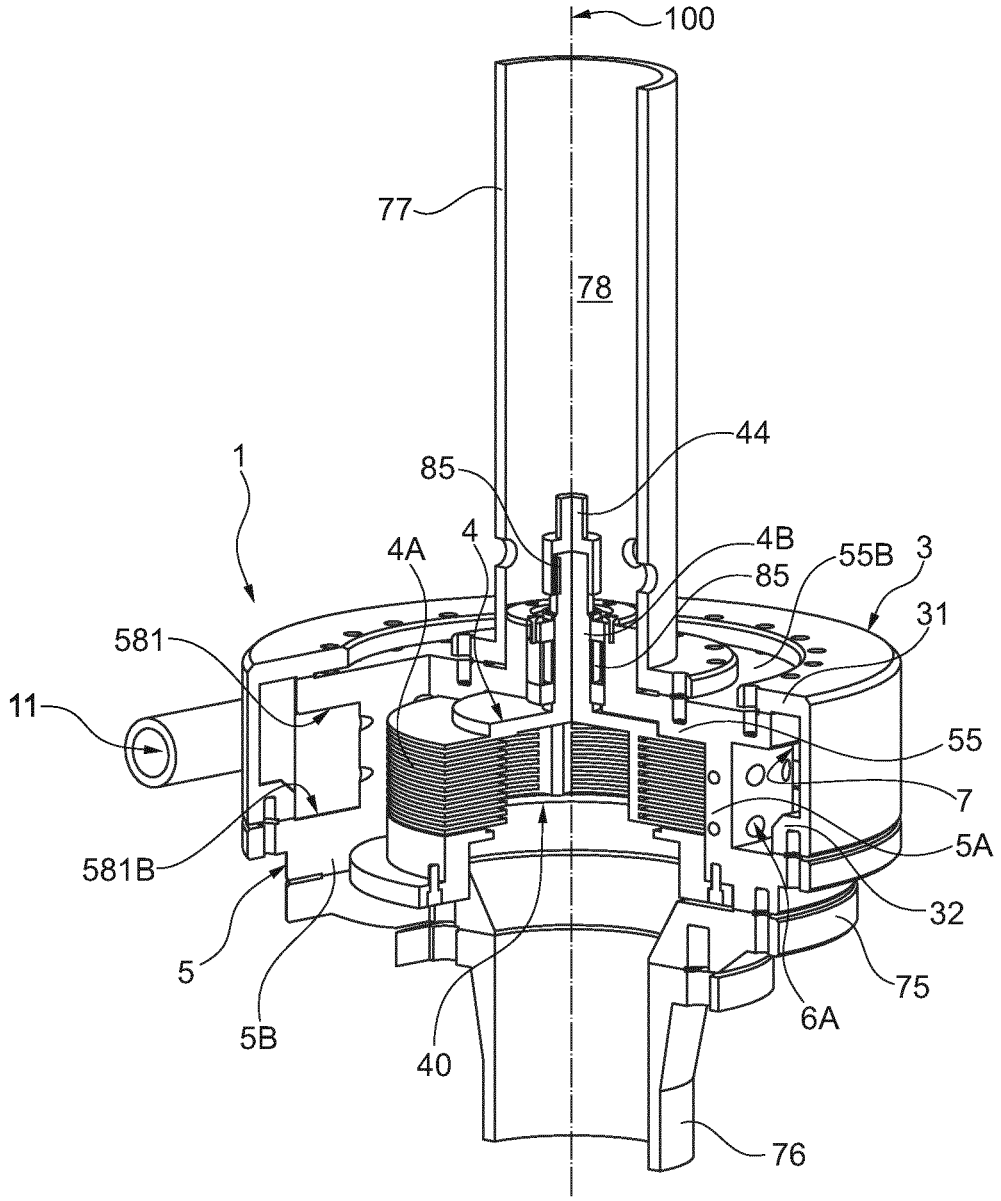
FIG. 1 is a section view of a possible embodiment of a turbine according to the present invention.

With reference to the mentioned Figures, the present invention relates to a disc turbine 1 which can be used to convert the energy associated with a fluid into mechanical energy made available at a shaft, which can be connected to an electrical generator.

The turbine 1 according to the invention comprises an internally hollow housing 3, which delimits a housing space 3A. The latter communicates with a feeding element of the fluid into the turbine 1. The expression "feeding element" generally indicates any element, e.g. a pipe, which defines a fluid inlet section 11, in liquid or gaseous form, in the housing 3 of the turbine.

The turbine 1 according to the invention comprises a rotor 4 which can rotate with respect to the housing 3 about a rotation axis 100. Such a rotor 4 can be connected to a shaft, so that the rotation of the rotor is transferred to the shaft itself. Such a shaft may be, for example, that of an electrical generator.

The rotor 4 comprises at least a first portion 4A comprising a plurality of disc elements 11A, 11B (hereinafter also indicated only as "discs 11A, 11B") which are coaxial to the rotation axis 100. Such a first portion 4A is arranged inside said housing space 3A. The disc elements 11A,11B are mutually spaced apart along a direction parallel to the rotation axis so that a passageway 15, intended to be crossed by the fluid, according to a principle known per se, is defined along a direction parallel to the rotation axis between two adjacent discs 11A,11B.

The turbine 1 according to the present invention is characterized in that it comprises a distributor 5 for addressing the fluid entering the turbine 1 towards the rotor 4. In particular, the distributor 5 comprises a distribution wall 5A inside the housing 3 (i.e. arranged in the aforesaid housing space 3A). Preferably, said distribution wall 5A internally surrounds the first part 4A of the rotor 4 defining the plurality of discs 11A, 11B. The distribution wall 5A and the housing define a diffusion chamber 7 which, at least partially, surrounds the same distribution wall 5A. The fluid entering the turbine 1 is diffused in such a chamber 7. Preferably, the chamber 7 nearly entirely surrounds said distribution wall 5A.

According to the invention, the distribution wall 5A comprises a plurality of nozzles 6A,6B,6C,66A,66B,66C, each of which comprises an inlet section 61 communicating with said chamber 7 and an outlet section 62 adjacent to said first portion 4A of said rotor 4. Furthermore, each of said nozzles has a converging portion 615 which accelerates the flow towards said outlet section 62.

Preferably, said nozzles 6A,6B,6C,66A,66B,66C are defined through distribution wall 5A itself. In other words, the nozzles are defined by surfaces of the distribution wall 5A itself. In an alternative embodiment, the nozzles could be defined inside bodies different from the distribution wall. Such bodies could be arranged in appropriate seats, defined through the distribution wall, so as to position the nozzles in a predetermined position and according to a predetermined orientation.

Figure 3:
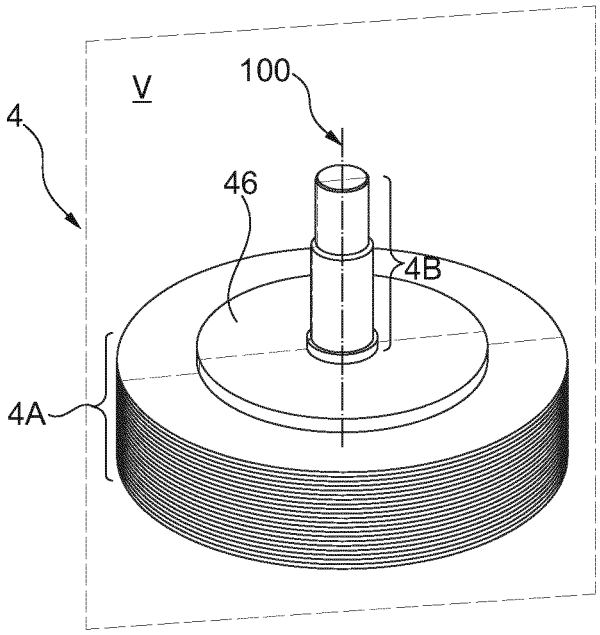
FIGS. 3 and 4 are a perspective view and a frontal view, respectively, of a possible embodiment of a rotor of a turbine according to the present invention.
Figure 4:
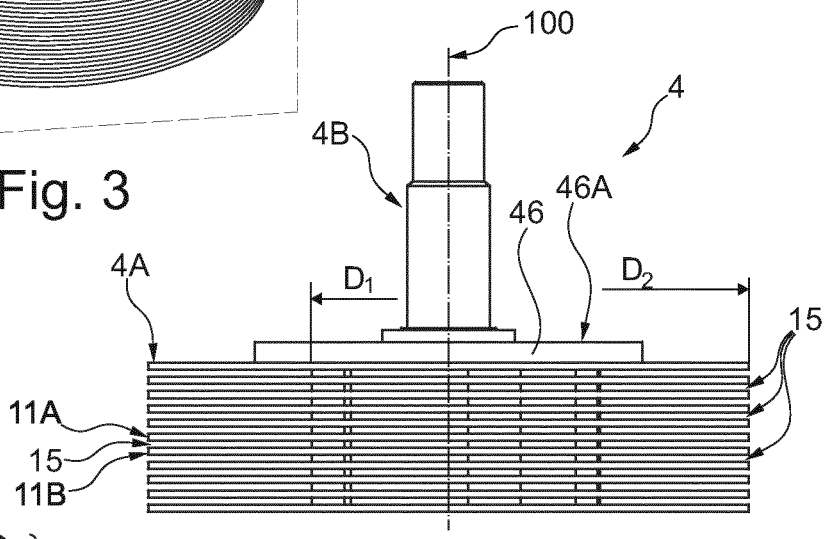

FIGS. 3 and 4 show a possible embodiment of the rotor 4. The discs 11A, 11B of the rotor 4 have the same shape and the same size. In particular, each disc 11A, 11B identifies an inner diameter D1 and an outer diameter D2. Preferably, the diameters D1 and D2 are the same for each disc. In all cases, given the conformation of the discs, the rotor 4 defines a discharge cavity 40, into which the fluid pours when it has crossed the passageways 15 defined between the discs 11A, 11B. Such a discharge cavity 40 substantially defines a discharge section of the turbine 1.

Figure 5:
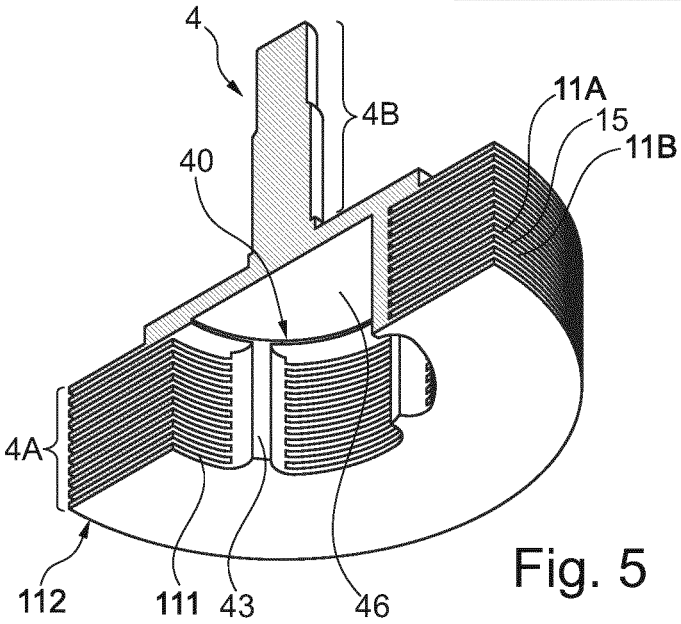
FIG. 5 is a section view according to the plane V-V in FIG. 3.
Figure 6:
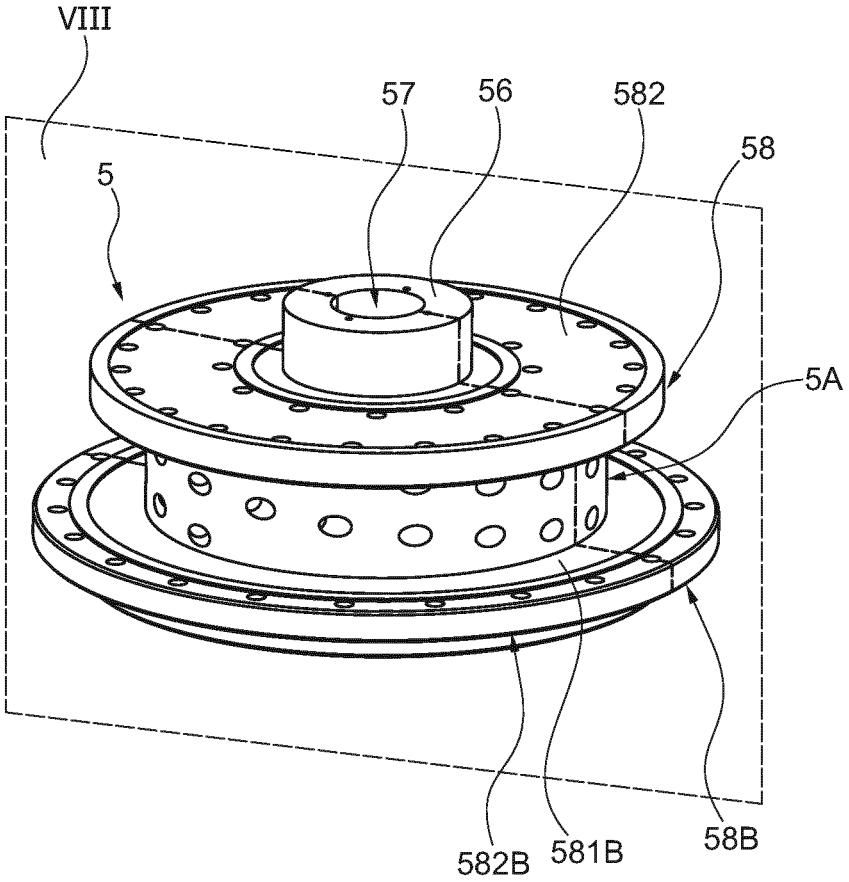
FIGS. 6 and 7 are a perspective view and a frontal view, respectively, of a possible embodiment of a distributor of a turbine according to the present invention.

According to a preferred embodiment, the first portion 4A of the rotor 4 is made as a single body, wherein the discs 11A,11B are defined by means of mechanical processes using machine tools starting from a single piece or a semi-finished part obtained by casting. Preferably, the first portion 4A made as a single body defines support portions 43 from which the discs 11A, 11B develop, as clearly shown in FIG. 5. Such support portions 43 develop axially (i.e. parallel to the rotation axis 100) and are defined at the innermost edge 111 of the discs 11A, 11B, thus resulting adjacent to the discharge cavity 40.

According to a preferred embodiment shown in the figures, the first portion 4A comprises a closing wall 46 which develops on a transversal plane, i.e. orthogonal to the rotation axis 100. Thereby, the discharge cavity 40 is axially closed in order to establish a mandatory discharge direction of the fluid of the turbine 1.

Again according to a preferred embodiment, the rotor 4 advantageously also comprises a second portion 4B which is integral with the first portion 4A. Such a second portion 4B is shaft-shaped and can be connected, for example, to an electrical generator (not shown). In general, the second portion 4B can be connected to any driven shaft 44, preferably by means of a cotter/tongue connection 85 (indicated in FIG. 1). Preferably, the second portion 4B develops starting from the closing wall 46 of the first portion 4A in opposite direction with respect to the discharge cavity 40.

Preferably, the rotor 4 is made in a single piece, thereby indicating that the first portion 4A and the second portion 4B are made in a single piece. In general, the entire rotor 4 may be defined by means of mechanical processes starting from a single piece or starting from a semi-finished part obtained by casting.

According to a preferred embodiment, the distribution wall 5A (hereinafter indicated more simply as "wall 5A") of the distributor 5 has a cylindrical conformation. More precisely, the wall 5A defines an innermost surface 51 and an outermost surface 52, both cylindrical. The innermost surface 51 faces and is adjacent to the discs 11A, 11B of the first portion 4A of the rotor 4, while the outermost surface 52 instead faces the innermost surface 310 of the housing 3. As a whole, the distribution wall 5A defines a cylindrical inner cavity 50, in which the first portion 4B of the rotor is housed.

Preferably, the diametrical extension of the innermost surface 51 substantially corresponds to the value of the outer diameter D2 of the discs 11A, 11B, minus a tolerance preferably in the order to tenths of mm. Therefore, the innermost surface 51 is adjacent to the outermost surface 112 (indicated in FIG. 5) of the discs 11A, 11B and the radial gap between the two concerned parts (51 and 112) is reduced to the minimum (preferably in the order of tenths of mm).

Again according to a preferred embodiment, the distributor 5 comprises a transversal wall 55 substantially orthogonal to the rotation axis 100. Such a transversal wall 55 has a central portion 56, which defines an axial opening 57 from which the second portion 4B of the rotor 4 protrudes. An innermost side 55A of the transversal wall 55 faces an outermost side 46A of the closing wall 46 of the first portion 4A of the rotor.

Preferably, the distributor 5 comprises a first annular portion 58, which defines a first edge surface 59, the distance of which from the rotation axis 100 (evaluated according to a radial direction) is greater than the diameter of the outermost surface 52 of the wall 5A. Substantially, the annular portion 58 emerges radially overhanging outwards (i.e. away from the rotation axis 100) with respect to wall 5A. Preferably, the first annular portion 58 develops at the same axial height (i.e. height along axis 100) at which the transversal wall 55 develops, thus constituting an extension thereof.

Even more preferably, the distributor 5 also comprises a second annular portion 58B, which defines a second edge surface 59B, the distance of which from the rotation axis 100 is greater than the diameter of the outermost surface 52 indicated above. In particular, such a distance may be either equal to or different from the distance of the first edge surface 59 of the rotation axis 100 itself. In all cases, the second annular portion 58B emerges radially resulting at least in part opposite to the first annular portion 58. Considering, for example, the section view in FIG. 7, the two annular portions 58,58B and the distribution wall 5A, as a whole, define a substantially C-shaped conformation, so that a first surface 581 of the first annular portion 58 faces a first surface 581B of the second annular portion 58B. In said C-shaped conformation, such surfaces 581, 581B are axially innermost. Each of the two annular portions 58, 58B further comprises a second surface 582, 582B which is opposite to the corresponding first surface 581,581B. Such second surfaces 582, 582B are axially outermost in said C-shaped conformation.

According to another aspect, the housing 3 is defined by a body comprising a main containing wall 33 which develops axially. Such a main wall 33 defines the innermost surface 310 of the housing 3 which faces the distributor 5 as indicated above. In particular, this main wall 33, and thus its innermost surface 310, radially delimits the chamber 7 in which the fluid entering the turbine is diffused through the inlet section 11 defined by the feeding conduit.

Preferably, the housing 3 comprises inside a closing wall 34, which prevents the fluid already diffused in the chamber 7 from mixing with the inlet fluid through the inlet section 11, thus avoiding disadvantageous turbulences. Therefore, the fluid entering the chamber 7 travels along it until it encounters such closing walls 34.

Figure 11:
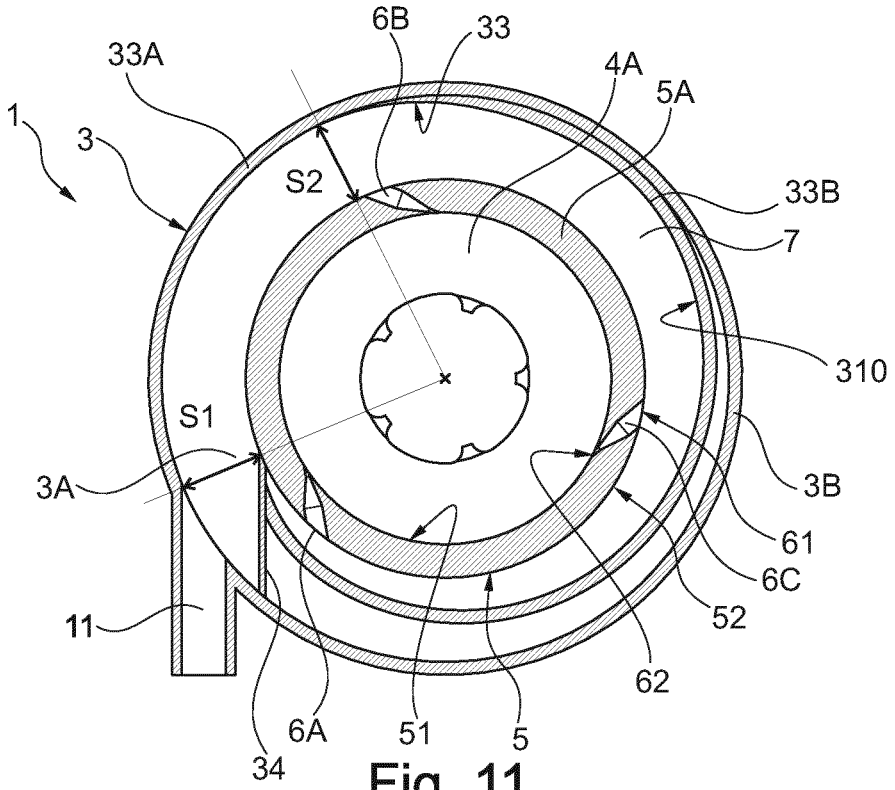
FIGS. 11 and 12 are section views related to two possible embodiments of a turbine according to the invention according to a section plane orthogonal to the turbine rotor axis.

According to a possible first embodiment shown in FIG. 11, the main wall 33 of the housing 3 has a substantially volute-shaped conformation, so that the chamber 7 has a first stretch, in which the area of the radial section is constant, and a second stretch, in which the area of the radial section decreases from a maximum value to a value which is substantially zero, at the closing wall 34.

In FIG. 11, the first stretch develops between the radial sections indicated by S1 and S2, while the second stretch develops between the radial section S2 and the closing wall 34. For the purposes of the present invention, radial section indicates a section of the chamber 7 evaluated on a radial plane containing the rotation axis 100. This conformation of the housing 3, and more in general of the chamber 7, ensures the same conditions of pressure and flow rate to each nozzle 6A,6B defined through the distribution wall 5A.

It is worth noting that in the conformation shown in FIG. 11, a first portion 33A of the main wall 33 is defined by the outermost wall of the housing 3, while a second portion 33B of the main wall 33 is more internal with respect to the outermost wall 3B itself of the housing 3.

Figure 12:
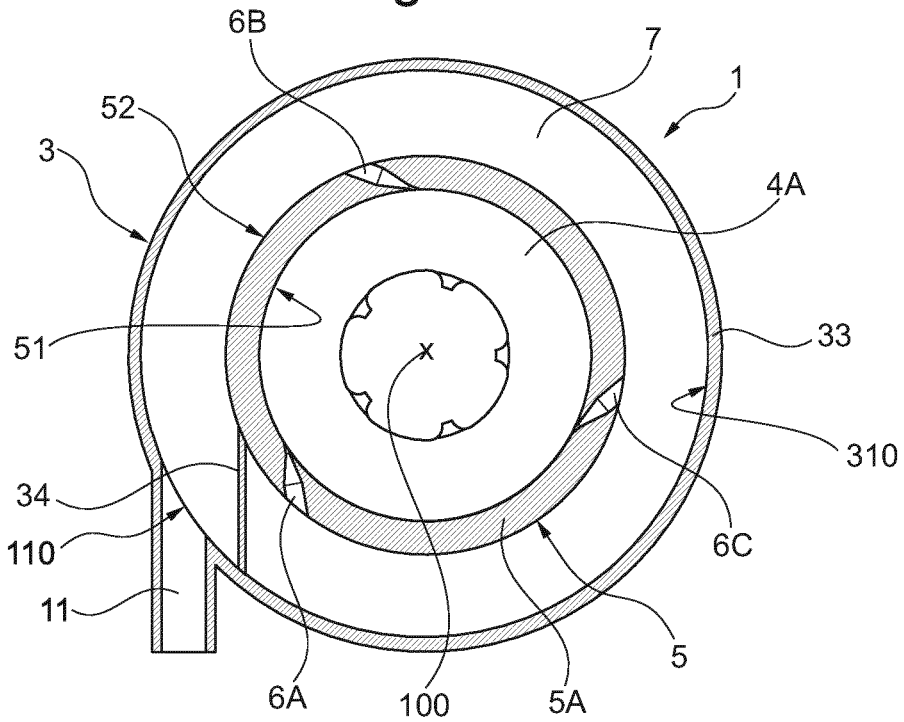

In the alternative embodiment shown in FIG. 12, the main wall 33 of the housing 3 corresponds to the outermost part of the housing itself and delimits, with the distributor 5, a chamber 7, in which the area of the radial section is substantially constant for the entire development of the chamber itself.

In all cases, the possibility of assigning a different conformation to the housing 3, and thus to the diffusion chamber 7, with respect to that described and shown in FIGS. 11 and 12, is included in the scope of the present invention.

Figure 2:
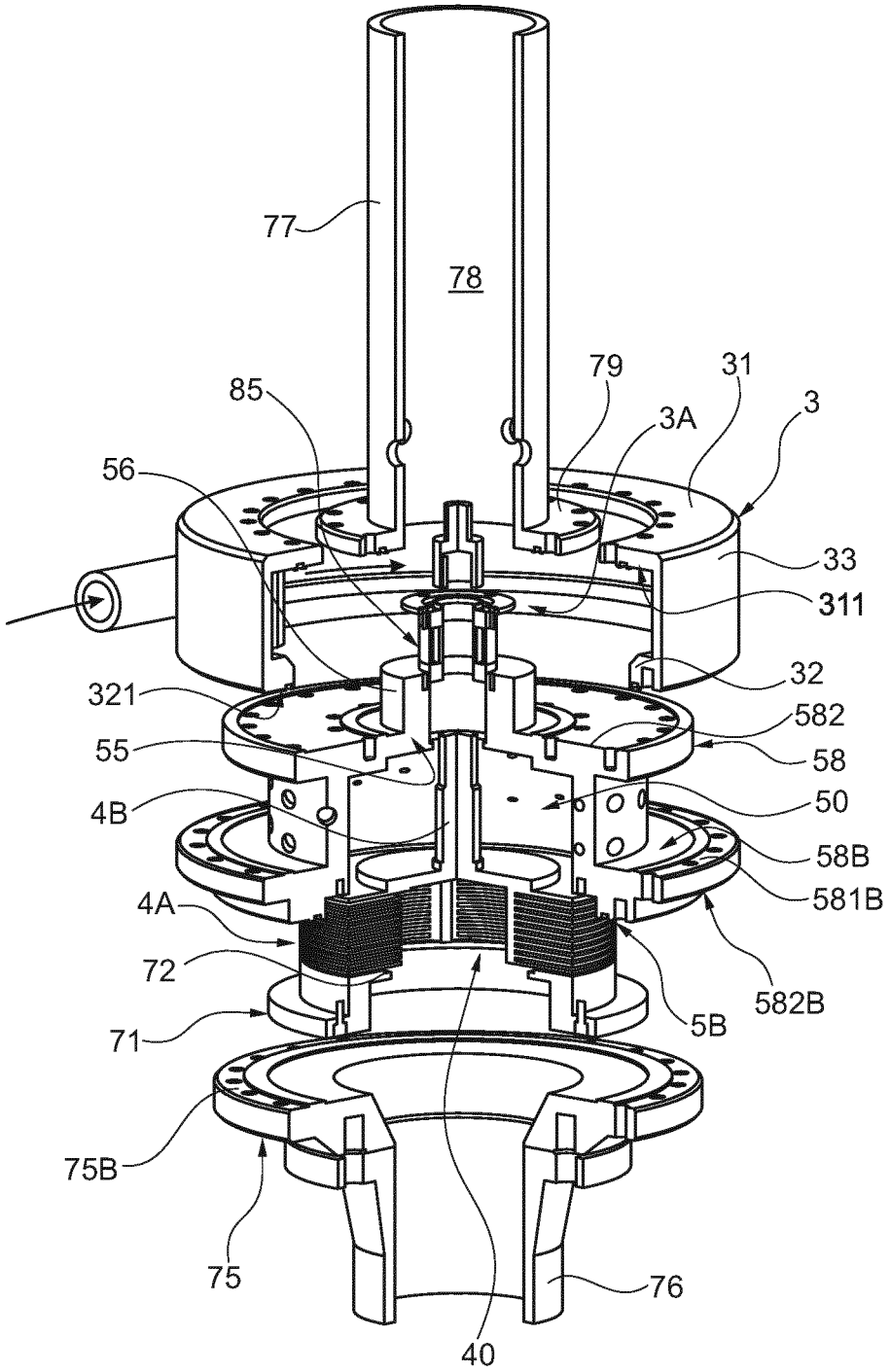
FIG. 2 is an exploded section view of the turbine in FIG. 1.

The housing 3 comprises two connection portions 31, 32 which develop from the outermost wall of the housing 3, in an annular manner (thus radially) towards the rotation axis 100 (see FIGS. 1 and 2). A first connection portion 31 is connected to the first annular portion 58 of the distributor 5, whilst a second connection portion 32 is connected to the second annular portion 58B of the distributor itself 5. After such a connection, the main wall 33, the connection portions 31,32, the wall 5A and the two annular portions 58,58B of the distributor 5 delimit the chamber 7 in which the inlet fluid is distributed in the turbine 1. The fluid intended to reach the passageways 15 defined between the discs 11A, 11B of the rotor 4 through the nozzles 6A,6B,6C,66A,66B, 66C preferably defined through the wall 5A, as described in greater detailed below.

The connection portions 31, 32 are connected to the corresponding annular portions 58,58B of the distributor 5 by means of a rigid connection, preferably made by means of a series of screws, as shown in the accompanying Figures. Preferably, the first connection portion 31 defines a contact surface 311 which rests against the second surface 582 (axially outermost) of the first annular portion 58. Also the second connection portion 32 defines a contact surface 321 which instead rests against the first surface 581B (axially innermost) of the second annular portion 58B. The latter description is a possible, and therefore not exclusive, connection mode between housing 3 and distributor 5. In general, according to the invention, the diffusion chamber 7 is indeed defined upon the connection between housing 3 and distributor 5.

According to a further aspect, the turbine 1 comprises a spacer collar 71, which is connected (e.g. by means of a screw fixing) to a terminal part 5B of the distribution wall 5A substantially close to the second annular portion 58B. Such a spacer collar 71 axially emerges inside the inner cavity 50 of the distributor 5 and defines an end surface 72 on which the first portion 4A of the rotor 4 rests. Substantially, the spacer collar 71 defines the axial position of the rotor itself with respect to the inner cavity 50.

According to a further aspect, also shown in FIGS. 1 and 2, the turbine 1 also comprises a closing flange 75 rigidly connected to the distributor 5, at the second annular portion 58B defined above. In particular, the flange 75 defines a contact surface 75B which rests against the aforesaid second surface 582B (axially outermost) of said second annular portion 58B. Preferably, the closing flange 75 is the outermost part of a discharge conduit 76 for the fluid output from the turbine 1. As shown in FIGS. 1 and 2, in a possible embodiment, the turbine 1 according to the invention could comprise a sleeve 77, e.g. cylindrical, comprising a flange end 79, which is connected to the outermost side 55B (opposite to the aforesaid innermost side 55A) of the transversal wall 55 of the distributor. Such a sleeve 77 defines an inner cavity 78 in which the structure of an electrical generator, which can be connected to the second portion 4B of the rotor 4, can be connected. It is worth noting that such a sleeve 77 is arranged in a position substantially opposite to the aforesaid discharge conduit 76.

According to a further aspect, it is worth noting that supports 85 (e.g. in the form of bearings), adapted to allow the free rotation of the rotor 4 with respect to the other components of the turbine 1 (in particular distributor 5 and housing 3), which maintain a first position, are preferably positioned inside the central portion 56.

As indicated above, the distributor 5 preferably defines a plurality of nozzles 6A, 6B, 6C, 66A, 66B, 66C by means of which the fluid circuiting the diffusion chamber 7 is accelerated and introduced into the passageways 15 defined between the discs 11A, 11B of the rotor. According to a first aspect, at least one nozzle has a conformation so that the surfaces defining the nozzle itself develop about a main axis 105 which identifies a direction along which the fluid is accelerated. Preferably, at least one nozzle is defined through the distribution wall 5A so that such a main axis 105 is substantially orthogonal to the rotation axis 100 of the rotor. Even more preferably, the main axis 105 does not intersect the rotation axis 100.

Figure 9:
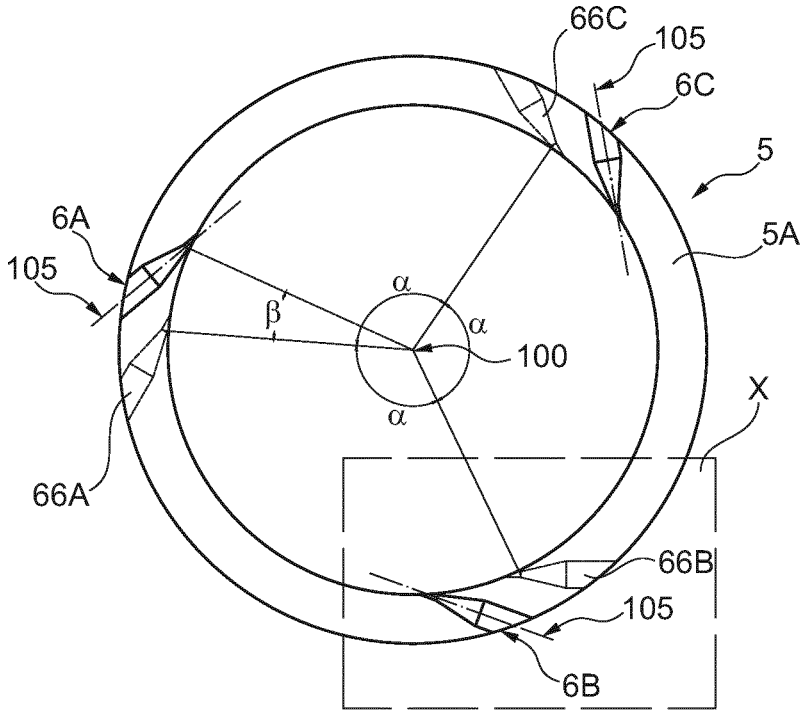
FIG. 9 is a view according to the section plane IX-IX in FIG. 8.
Figure 10:
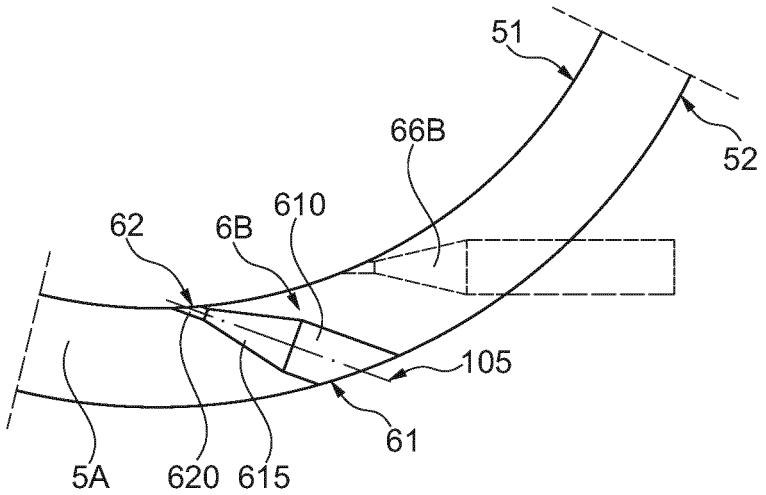
FIG. 10 is an enlargement of detail X indicated in FIG. 9.

FIG. 10 is an enlargement of FIG. 9. The latter is a view of the distributor 5 according to a section plane substantially orthogonal to the rotation axis 100 of the rotor 4. Said enlargement allows to observe the conformation of the nozzle shown by reference 6B. Such a conformation includes an inlet section 61 at the outermost surface 52 of the distributor 5 and an outlet section 62 at the innermost surface 51 of the distributor. As indicated above, the surfaces of the nozzle 6B develop about said main axis 105.

In particular, the nozzle 6B comprises a first portion 610, with greater diameter, which develops about said main axis 105 starting from the inlet section 61 to a first inner section 61. The nozzle further comprises a truncated-cone-shaped second portion 615 and a third portion 620, having smaller diameter, which defines the outlet section 62 of the nozzle. The second portion 615 converges towards the third portion 620 so that the fluid which crosses it is accelerated to the detriment of the pressure of the fluid itself.

In an alternative embodiment, the nozzle could comprise only the first portion 610 and the truncated-cone-shaped second portion 615. In this case, the outlet section 62 of the nozzle would be defined as the end section of the truncated-cone-shaped portion.

Preferably, with reference to FIG. 9, the conformation of all the nozzles 6A, 6B, 6C, 66A, 66B, 66C defined through the wall 5A of the distributor 5 corresponds to that described above. As a whole, the conformation assigned to the nozzles advantageously allows to convert the potential energy of the fluid entering the turbine into kinetic energy which is transferred to the rotor 4 of the turbine itself. It is worth noting that depending on the fluid type and/or the power which is intended to be obtained from the shaft of the rotor, the size of the nozzle 6B may vary thus make the degree of energy conversion vary. In this regard, the length of the portions 610,615,620 of the nozzle 6B and the diameter of the portions may be defined to achieve a supersonic speed of the fluid so as to obtain an energy conversion efficiency (from potential to kinetic) even higher than 90%.

In a further embodiment, a nozzle (or more nozzles) could be defined only by a converging portion which develops between the inlet section 61 and the outlet section 62. In this hypothesis, the nozzle would not comprise sections having constant diameter.

According to another alternative, downstream of the converging portion, one nozzle (or multiple nozzles) may comprise an intermediate portion with constant diameter (diameter equal to the smallest section of the converging portion). Downstream of the intermediate portion there could be a further diverting portion, in which the diameter increases from a minimum value (corresponding to that of the intermediate section) to a maximum value corresponding to the outlet section of the nozzle. As a whole, the intermediate portion and the diverging portion configure a sonic neck and a diffuser, respectively.

In general, the configuration of the nozzles may vary as a function of the type of fluid, of the power which is intended to be obtained and thus of the speed required to optimize the turbine operation.

According to another aspect of the present invention, the nozzles 6A, 6B, 6C, 66A, 66B, 66C are distributed through the distributor 5 so that the corresponding main axis 105 is located in an intermediate position between two mutually adjacent discs 11A, 11B of the rotor 4. Preferably, for each nozzle, the diameter of the outlet section 62 has a value smaller than the distance between the adjacent discs 11A, 11B (distance measured parallel to the rotation axis 100). This technical solution allows the fluid accelerated by the nozzle to be inserted in the space between the two adjacent discs 11A, 11B without colliding into the outermost edge 112 of the discs themselves. Thereby, the momentum of the fluid transforms into drive torque for the motor shaft during the flowing of the fluid between the two discs due to the viscous behavior of the fluid.

Figure 7:
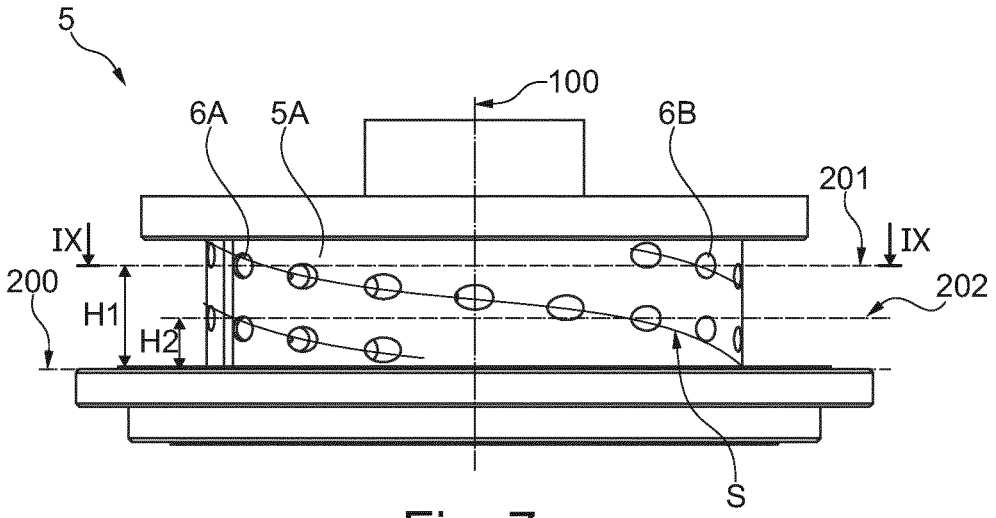
Figure 8:
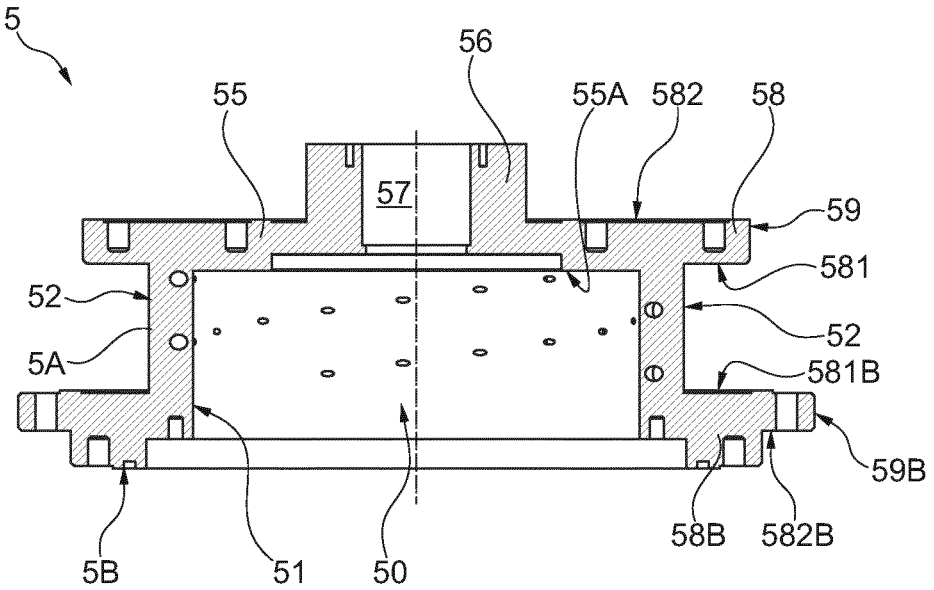
FIG. 8 is a view according to the section plane VIII-VIII in FIG. 6.

According to a preferred embodiment shown in the figures, the plurality of nozzles comprises at least a first group of nozzles 6A, 6B, 6C, the main axes 105 of which are arranged on the same first lying plane 201 placed at the first height H1 with respect to a reference plane 200, preferably orthogonal to the rotation axis 100 of the rotor 4. In particular, according to the objects of the invention, such a first lying plane 201 occupies a position between the two adjacent discs 11A, 11B and is preferably orthogonal to the rotation axis 100 of the rotor 4. It is worth noting that the reference plane 200 indicated above may assume any position. In FIG. 7, for example, it was indicated at the base of the distribution wall 5A.

According to the invention, the nozzles 6A, 6B, 6C of said first group are defined so as to be angularly equally spaced apart with respect to the rotation axis 100. This indicates an arrangement of the nozzles 6A,6B,6C such that each nozzle (e.g. 6A) is arranged at the same angular distance with respect to another nozzle contiguous thereto (6B and 6C). In the solution shown in FIG. 9, for example, the first group comprises three nozzles 6A,6B,6C which are angularly equally spaced apart by an angle $\alpha$ of 120°. It has been seen that such an equally spaced-apart angular arrangement of the nozzles 6A, 6B, 6C about the rotation axis 100 allows to obtain a pure rotation torque about the axis itself, thereby either minimizing or avoiding the flexural loads.

According to an embodiment of the invention, the distributor 5 defines a series of nozzle groups for each of which the main axes 105 of the nozzles is arranged on a lying plane 201, 202 arranged at a predetermined height H1, H2 with respect to a reference plane 200 which is substantially orthogonal to the rotation axis 100 of the rotor 4. In particular, for each of such groups, the corresponding lying plane 201,202 occupies a position between two mutually adjacent discs 11A, 11B.

In this regard, the profile of the nozzles 6A, 6B, 6C of the first group of nozzles is shown by a solid line in the section view in FIG. 9. Instead, the profile of the nozzles 66A, 66B, 66C of the second group, the main axes 105 of which lie on a lying plane 202 (indicated in FIG. 7) different from the first lying plane 201 related to the nozzles 66A,66B,66C of the first group, is shown by a dashed line. In general, for each of the nozzle groups, the corresponding lying plane 201,202 of the main axes 105 occupies a position between two mutually adjacent discs 11A, 1B.

According to another aspect, it is worth noting that each nozzle of the first group of nozzles 6A, 6B, 6C is angularly spaced apart with respect to a corresponding nozzle of a second group of nozzles 66A,66B,66C adjacent to the first one. In the embodiment shown in FIG. 9, for example, each nozzle of the first group of nozzles 6A, 6B, 6C is angularly spaced apart by an angle $\beta$ with respect to a corresponding nozzle of the second group of nozzles 66A, 66B, 66C. Such an angle $\beta$ may assume different values, preferably within a range from 10° to 50°.

With reference to FIG. 7, it is worth noting that due to the angle $\beta$, the mutual arrangement of the nozzles identifies a helical line S which develops about the rotation axis 100. As a whole, this helical arrangement contributes to establishing the torque generated by the discs when the fluid passes.

According to a further aspect indicated in the enlargement in FIG. 10, it is worth noting that the nozzles may be advantageously made by means of simple drilling operations made by means of one or more tools. In particular, the last finishing operation may be performed by means of a tool the shape of which geometrically corresponds to that of the considered nozzle. Such a tool is diagrammatically shown in FIG. 10 by a dashed line.

If the nozzles are defined through support bodies different from the distribution wall by means of equally simple drilling and/or milling operations, seats can be defined for positioning such support bodies through the distribution wall. In all cases, the assembly of the turbine appears considerably simplified with respect to that required by the known turbines of the prior art.

The operation of the disc turbine according to the present invention will now be described with reference to FIGS. 1 and 2. The fluid is distributed in the diffusion chamber 7 defined between the distributor 5 and the housing 3 by means of the feeding channel, and thus the inlet section 11. Due to the chamber 7, the fluid reaches all the nozzles 6A, 6B, 6C, 66A, 66B, 66C substantially in the same thermodynamic conditions. The nozzles 6A, 6B, 6C, 66A, 66B, 66C convert the fluid pressure into a momentum achieving a first enthalpy with an efficiency very close to 100%. The position assigned to the nozzles 6A, 6B, 6C, 66A, 66B, 66C addresses the fluid between the discs 11A, 11B of the rotor 4 so that the thrust of the fluid is transformed into a drive torque and thus mechanical power made available to the shaft of the rotor itself. In this regard, the spatial arrangement of the nozzles 6A, 6B, 6C, 66A, 66B, 66C allows the rotor 4 to be loaded by a single drive torque without any unbalanced side load.

Due to its conformation, the rotor 4 imposes an 90° deflection to the fluid transiting in the passageways 15 defined between the discs 11A, 11B, thereby maximizing the variation of the momentum of the fluid and therefore the extracted mechanical power.

The technical solutions described allow to fully achieve the predetermined tasks and objects. In particular, the disc turbine allows a conversion efficiency (from potential energy of the fluid to mechanical energy) higher than that achieved in the traditional solutions. In particular, the use of a diffusion chamber combined with the use of a distributor defining the nozzles allows to obtain a high degree of potential energy conversion into kinetic energy, which is then converted, by means of the interaction of the fluid with the rotor discs, into mechanical energy.

The invention claimed is:

1. A disc turbine for converting the energy associated with a fluid into mechanical energy, said turbine comprising:

a housing communicating with a fluid inlet section;

a rotor inside said housing which can rotate with respect to it about a rotation axis, said rotor comprising a plurality of disc elements coaxial with said rotation axis and spaced apart so that a passageway communicating with a discharge cavity for discharging said fluid is defined between each pair of adjacent disc elements; and a distributor comprising at least one distribution wall, which at least partially surrounds said disc elements, said distribution wall being arranged inside said housing so that a diffusion chamber is defined between said distribution wall and said housing, which chamber at least partially surrounds said distribution wall, said distribution wall comprising a plurality of nozzles, each of which is provided with an inlet section communicating with said chamber, an outlet section adjacent to said disc elements and at least one converging portion which accelerates said fluid towards said outlet section, wherein at least one nozzle of said plurality of nozzles develops about a main axis which identifies a direction along which said fluid is accelerated and wherein said main axis is arranged in an intermediate position between two adjacent discs elements of said rotor.

2. The turbine according to claim 1, wherein said rotor comprises a first portion with said disc elements and a second portion, integral with the first portion, wherein said first portion defines the discharge cavity and wherein said second portion is configured as a shaft.

3. The turbine according to claim 2, wherein said first portion of said rotor is defined as a single piece or wherein said first portion and said second portion are defined as a single piece.

4. The turbine according to claim 1, wherein at least one of said nozzles is defined directly through said distribution wall.

5. The turbine according to 1, wherein said distribution wall has a cylindrical conformation which completely surrounds said disc elements of said rotor.

6. The turbine according to claim 1, wherein said housing comprises a closing wall of said diffusion chamber, said closing wall preventing the fluid circuiting in said chamber from mixing with the fluid entering the chamber itself.

7. The turbine according to claim 6, wherein said housing comprises a main wall which defines said chamber with the distributor, wherein said main wall has a substantially volute-shaped conformation defined by at least a first stretch, in which the area of the radial section of said chamber is constant, and by a second stretch, in which said area decreases from a maximum value to a minimum value at said closing wall.

8. The turbine according to claim 1, wherein said chamber is configured upon the mechanical connection of said distributor to said housing.

9. The turbine according to claim 8, wherein said distributor comprises a first annular portion and a second annular portion at least partially opposite to said first annular portion, said annular portions emerge radially with respect to said distribution wall, said housing comprising a first connection portion which develops radially inwards and which is connected to said first annular portion of said distributor, said housing further comprising a second connection portion which radially develops inwards and which is connected to said second annular portion.

10. The turbine according to claim 1, wherein said outlet section of said at least one nozzle has a diameter which is either smaller than or equal to the distance between said adjacent discs.

11. The turbine according to claim 1, wherein each of said nozzles of said distributor develops about a corresponding main axis which identifies a direction along which said fluid is accelerated, and wherein for each nozzle, the corresponding main axis is arranged in an intermediate position between said discs.

12. The turbine according to claim 11, wherein said plurality of nozzles comprises at least one group of nozzles the main axes of which are arranged on a lying plane arranged at a predetermined height (H1) with respect to a reference plane substantially orthogonal to said rotation axis of said rotor, said lying plane occupying a position between two adjacent discs.

13. The turbine according to claim 12, wherein said nozzles of said at least one group of nozzles are angularly equally spaced apart with respect to said rotation axis.

14. The turbine according to claim 12, wherein said plurality of nozzles comprises at least a first group of nozzles and at least a second group of nozzles adjacent to said first group of nozzles, and wherein each nozzle of the first group of nozzles is spaced apart by a predetermined angle (β) with respect to a corresponding nozzle of a second group of nozzles adjacent to the first one.

* * * * *